US005839124A

United States Patent [19]

Tilton

[11] Patent Number: 5,839,124

[45] Date of Patent: Nov. 24, 1998

[54] WEDGE SYSTEM FOR BOWLER'S WRIST AND HAND BRACE

[76] Inventor: James Tilton, 38448 20th St. E., Palmdale, Calif. 93550

[21] Appl. No.: 912,659

[22] Filed: Aug. 18, 1997

Related U.S. Application Data

[63] Continuation-in-part of Ser. No. 800,449, Feb. 18, 1997, Pat. No. 5,708,981.

[51] Int. Cl.[6] ..... A41D 13/08

[52] U.S. Cl. ..... 2/170; 2/161.1

[58] Field of Search ..... 2/159, 158, 161.4, 2/161.1, 170, 162, 163, 166; 602/21, 22

[56] References Cited

U.S. PATENT DOCUMENTS

| | | | |
|---|---|---|---|
| Re. 32,566 | 12/1987 | Patton, Jr. | 2/161.1 |
| 3,031,680 | 5/1962 | Compiano | 2/159 |
| 3,038,723 | 6/1962 | Bergendorf | 2/159 |
| 3,117,786 | 1/1964 | Anderson | 2/159 |
| 3,149,839 | 9/1964 | Materia | 2/159 |
| 4,332,382 | 6/1982 | Smith | 2/161.1 X |
| 4,441,711 | 4/1984 | Dubar et al. | 2/161.1 X |
| 5,330,391 | 7/1994 | Mitchell | 2/161.1 X |
| 5,427,577 | 6/1995 | Picchietti et al. | 2/161.1 X |
| 5,445,566 | 8/1995 | Hayes | 2/161.1 X |
| 5,492,331 | 2/1996 | Kawakami | 2/159 X |
| 5,708,981 | 1/1998 | Tilton | 2/170 |

*Primary Examiner*—Gloria M. Hale
*Attorney, Agent, or Firm*—Roger A. Marrs

[57] ABSTRACT

A wrist and hand support for bowlers, including an elongated cushioned base supporting an elongated laterally or transversely flexible brace member against the back of the hand and wrist of the bowler. Straps having hook and pile fasteners releasably retain the brace member in position as well as the cushioned base on the bowler's hand and wrist. The brace member includes an elongated sheath having open end pockets for receiving the opposite ends of a plurality of spaced-apart rods arranged in spaced-apart relationship. The rods are rigid and may be arranged in parallel or in angled relationship on the sheath with the separating sheath material forming flexible areas permitting the brace member to flex laterally along its length or about its longitudinal axis as viewed from the end of the brace member. Therefore, the user's hand and wrist are rigidly supported which aids the bowler in delivering a bowling ball down a bowling alley. Wedge elements may be inserted between the brace member and the back of the hand having different degrees of tilt so as to increase or decreate rotation of wrist motion placed on the bowling ball.

13 Claims, 4 Drawing Sheets

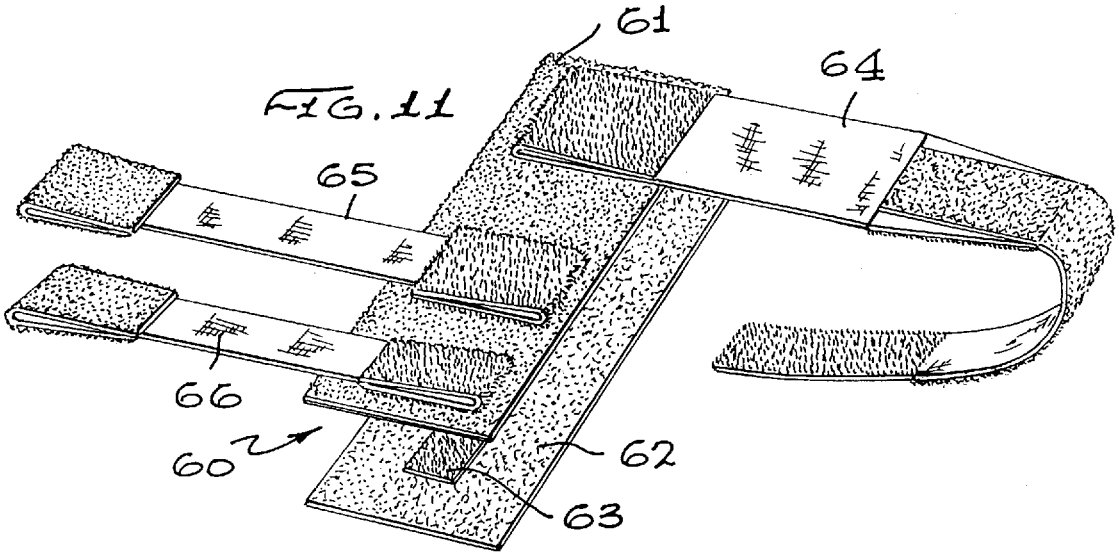
FIG. 11
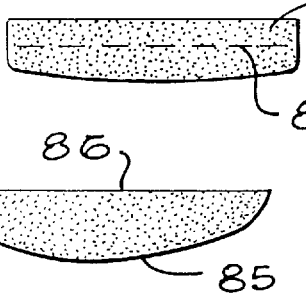
FIG. 15
FIG. 16
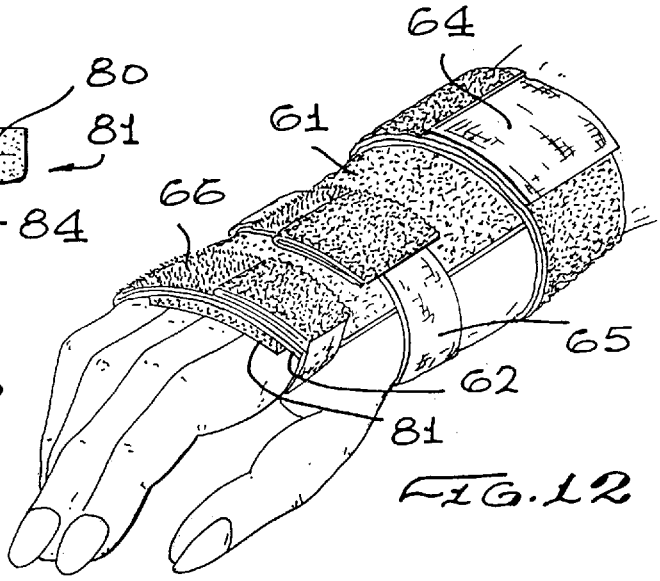
FIG. 12
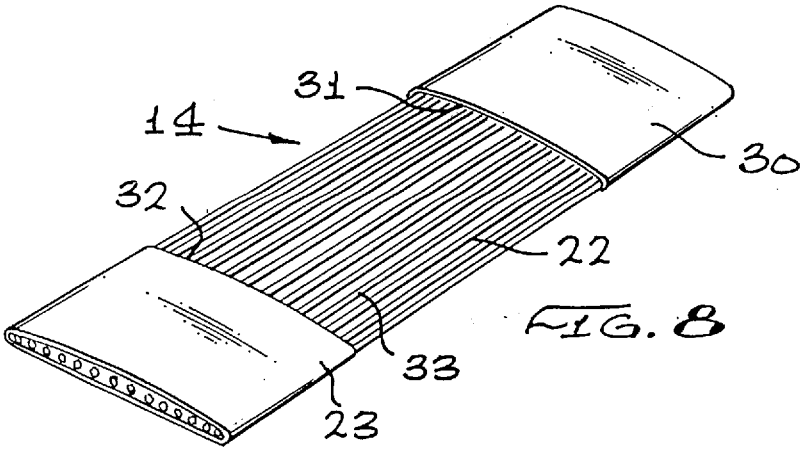
FIG. 8

FIG. 13
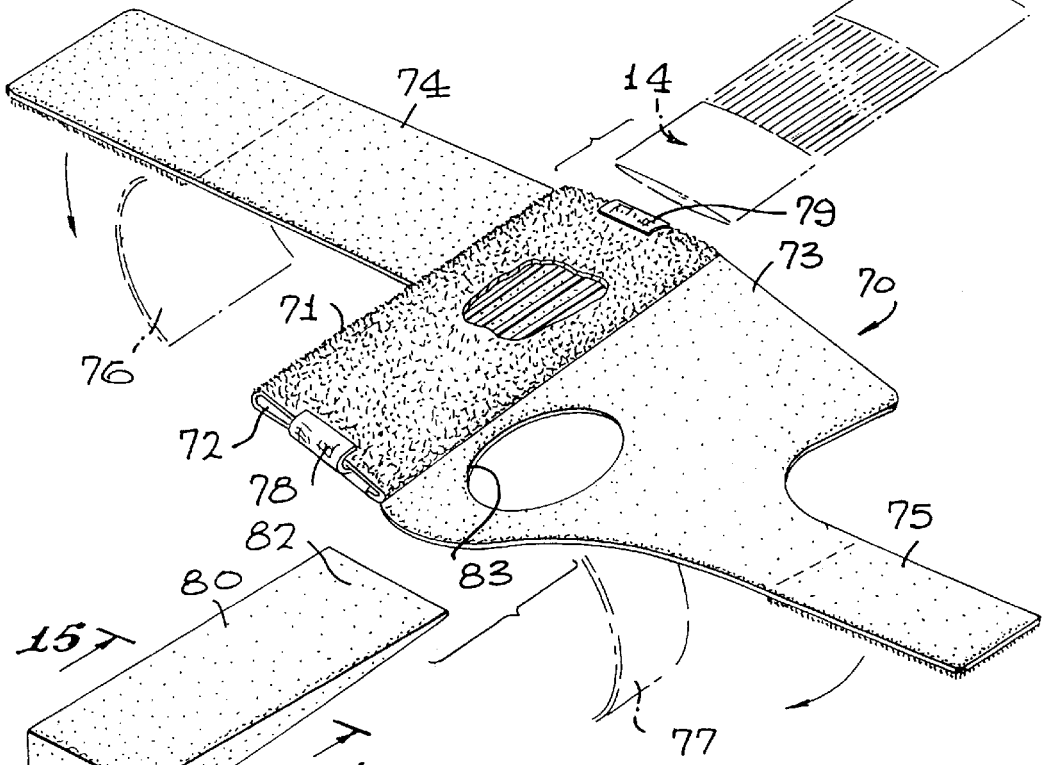
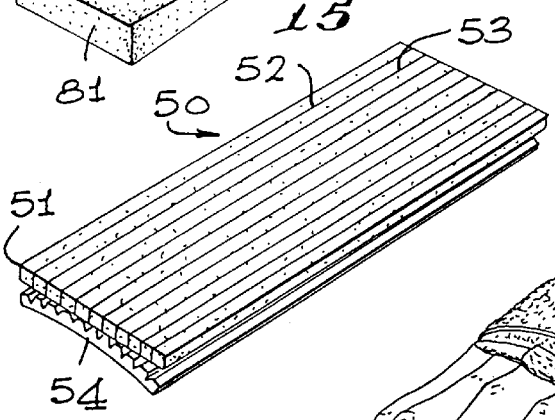
FIG. 9
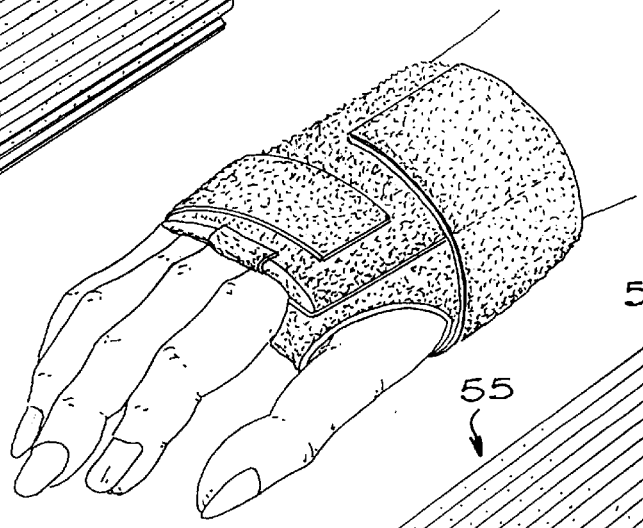
FIG. 14
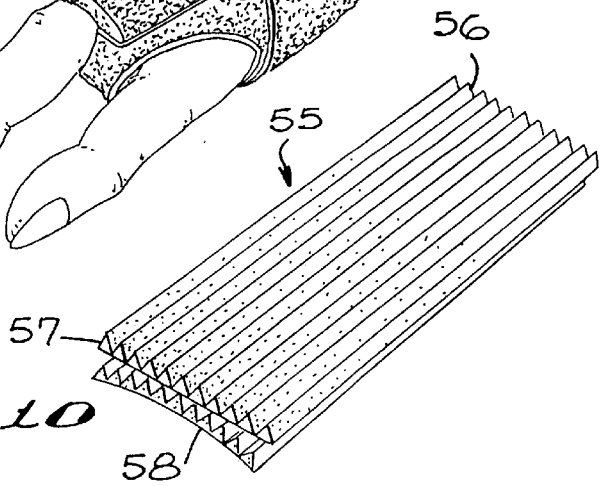
FIG. 10

WEDGE SYSTEM FOR BOWLER'S WRIST AND HAND BRACE

This is a continuation in-part of U.S. application Ser. No. 08-800,449, now U.S. Pat. No. 5,708,981 filed Feb. 18, 1997 on which priority is claimed.

BACKGROUND OF THE INVENTION

1. Field of the Invention

The present invention relates to the field of sports aids and accessories, and more particularly to a novel wrist brace intended to be worn by a bowler, which adjustably provides for ball rotation and the bowler with rigid longitudinal support while permitting lateral or transverse flexibility during delivering of a bowling ball down a bowling alley.

2. Brief Description of the Prior Art

In the past, a variety of gloves and hand supports have been used in the game of bowling intended to support the bowler's hand or wrist while the bowling ball is being delivered towards a pattern of pins. The conventional gloves or supports are designed to be used on either the left or right hand of the user and are not interchangeable between the hands. Such a prior art support is disclosed in U.S. Design Pat. No. D-288,372. Such a glove or support is not flexible and will not conform to the user's hand during the course of play. The support element employed is entirely rigid in both its longitudinal and transverse axes and because of the specific design for right or left-handed persons, the support for the rigid member is not adapted to be interchanged and, therefore, a manufacturer must make two different categories of gloves or braces so that both right and left-handed persons can be accommodated.

Furthermore, a bowler's effectiveness involves the bowler's ability to control rotation of the ball when delivered to the alley. Prior braces provide adjustment for different angles by employing screws or other metal hardware. These are cumbersome to adjust, weight the entire brace and are not readily adjustable since hand tools are often required.

Therefore, a long-standing need has existed to provide a brace for a bowler's hand and/or wrist which may be worn on either the right or the left hand of the bowler and which will permit lateral flexure of the rigid support member while preventing longitudinal bending or flexure when the brace is worn by the user. The brace may provide for adjustment so that rotational control of the ball can be obtained by the bowler. The brace described in my co-pending application Ser. No. 08-800,449 may incorporate the present invention.

SUMMARY OF THE INVENTION

Accordingly, the above problems and difficulties are avoided by the present invention which provides a novel bowler's wrist brace or support which includes an elongated base having a cushion portion providing comfort to a bowler whether the brace is worn on the left or the right hand. An elongated brace member is carried on the base in a position at the back of the user's wrist and hand so as to prevent flexure of the wrist during the tossing or throwing of a ball during a game. The brace member is provided with an elongated rigid member which permits lateral flexure while preventing longitudinal bending or flexure. In one form of the invention, the brace member includes a plurality of elongated rigid members which are arranged in spaced-apart, side-by-side relationship in either parallel relationship, radiating or fanned arrangement or other angular relationship. The areas of the base member separating the adjacent ones of the rigid members permit lateral flexure when the aid or device is being used. However, the rigidity of the elongated rods prevents longitudinal flexure so that the user's wrist maintains the hand in an unmovable position. Separate insertable wedges selected from a variety of differently shaped cross-sections are disposed between the underside of the base member and the back of the user's hand.

Straps integral with the base are wrapped about the back of the user's wrist so as to maintain the aid in position on the back of the hand and wrist of the user. Fastening means are employed for detachably connecting the straps to the base so as to maintain the rigid brace member in position against the back of the user's hand and wrist.

Therefore, it is among the primary objects of the present invention to provide a bowler's glove or brace which prevents longitudinal bending while permitting lateral flexure when the aid is releasably attached to the back of the user's hand and wrist.

Yet another object of the present invention is to provide a novel bowler's hand and wrist support which may be employed interchangeably for right or left-handed persons.

Another object of the present invention is to provide a single hand and wrist support which includes straps that may be wrapped about the hand and wrist of the user so that either right or left-handed persons may use the aid while engaging in the game of bowling.

Still another object of the present invention is to provide a hand and wrist brace for bowlers which includes straps for releasably holding the aid onto the user's hand and wrist which applies a pulling force towards the body of the user so as to hold the brace in place at the start of a ball tossing procedure.

A further object resides in providing a selectable wedge system for placement under the wrist brace for the purpose of providing different degrees of tilt so as to increase or decrease rotation that the wrist may place on the bowling ball.

Still another object incorporates a wedge system having a varied set of shaped wedges consisting of different angles that a detachably fastened to the underside of the brace member. Such shaped wedges are not limited to top-to-bottom angles but may have side-to-side angles.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 8 is a perspective view of a rigid member used to stiffen the body member while allowing lateral flexure;

FIG. 9 is a perspective view of another version of a rigid member permitting lateral flexure;

FIG. 10 is a perspective view of another version of a rigid member permitting lateral flexure;

FIG. 11 is a perspective view of another embodiment of a wrist/hand support aid;

FIG. 12 is a perspective view of the embodiment shown in FIG. 11 in use on the hand of a bowler;

FIG. 13 is a perspective view of another version of wrist/hand support aid adapted to employ the wedge system of the present invention;

FIG. 14 is a perspective view of the support aid shown in FIG. 13 in actual use on the hand of a bowler;

FIG. 15 is a cross-sectional view of a wedge as used in the version shown in FIG. 13; and FIG. 16 is an alternate wedge available for use in place of the wedge shown in FIG. 15.

DESCRIPTION OF THE PREFERRED EMBODIMENT

Figure 1:
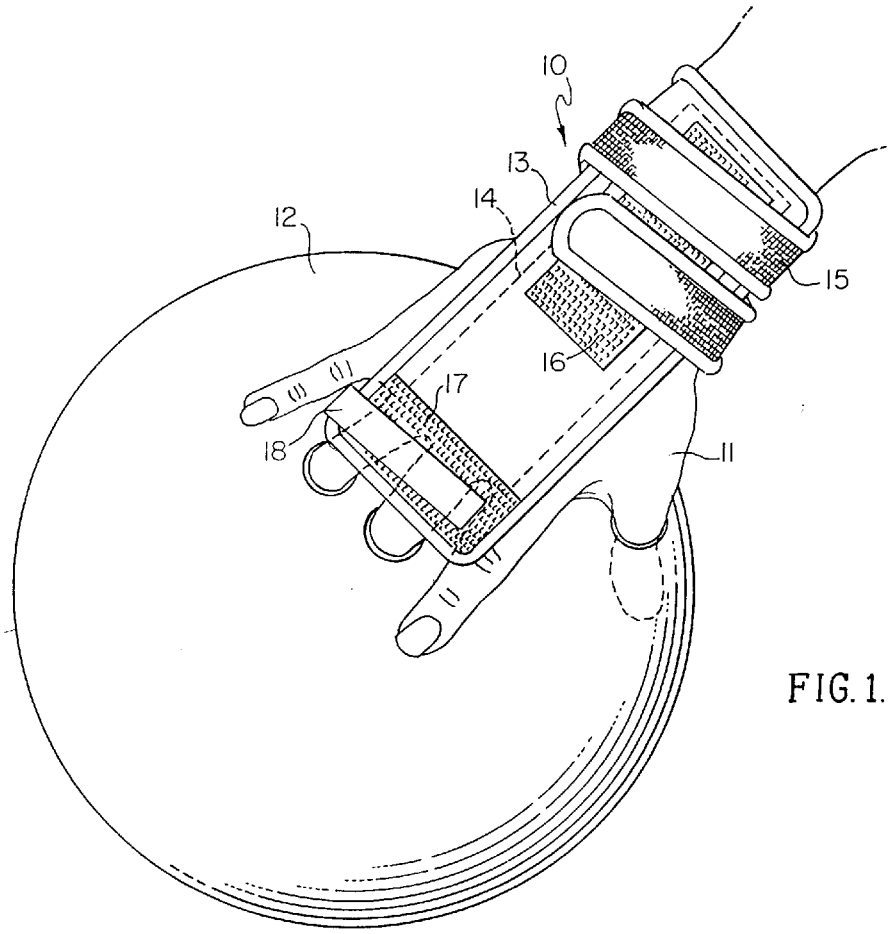
FIG. 1 is a top view of the wrist/hand support aid for bowlers incorporating the present invention and illustrated in connection with the delivery or tossing of a bowling ball.

Referring to FIG. 1, the novel wrist/hand brace of the present invention is illustrated in the general direction of arrow 10 and is illustrated in connection with the hand of a user illustrated by numeral 11 with the fingers of the hand inserted into respective holes in a bowling ball 12. The brace 10 includes a base 13 covering an elongated brace member 14 illustrated in broken lines. The longitudinal length of the brace member 14 extends from the back of the wrist of the user to the back of the hand terminating in an area about the joints of the fingers with the hand. The base 13 includes a wrist strap 15 which encircles the wrist and the back end of the base and terminates in a hook and pile fastening arrangement of which pile component 16 is carried on the exposed rear or back end of the base. The forward end of the base includes a hook component 17 which detachably connects with the end of a finger strap represented by numeral 18. Therefore, when the wrist brace is worn by the user, bending between the wrist/hand is prevented by the rigid brace member 14. The straps 15 and 18 releasably and detachably secure the brace to the wrist and back of the hand of the user.

Figure 2:
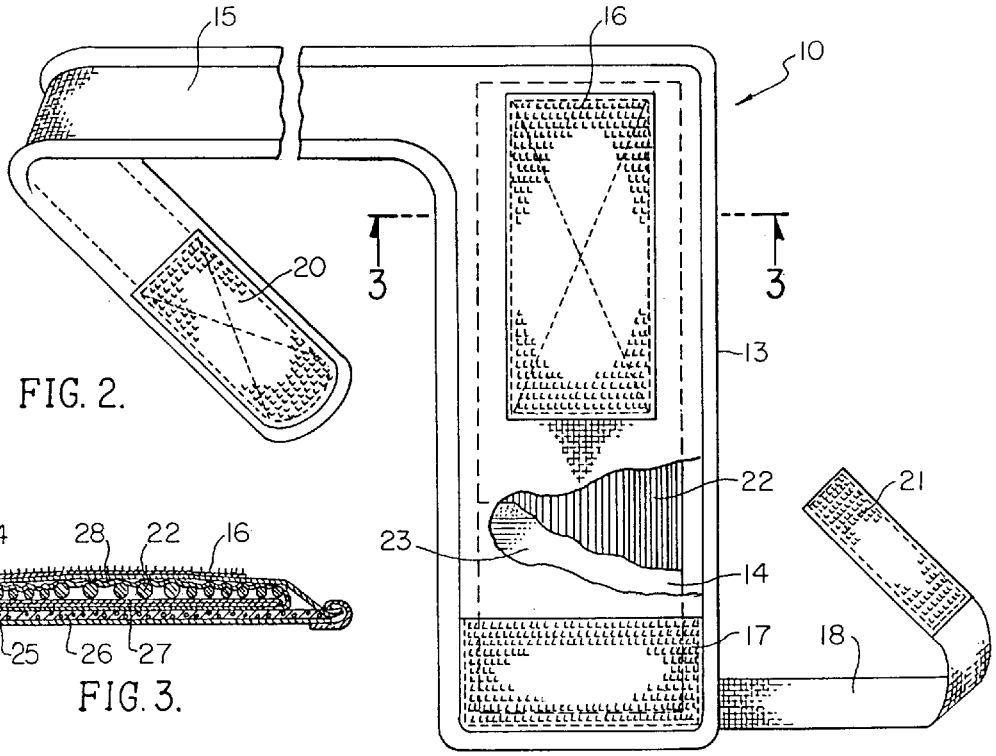
FIG. 2 is a top perspective view of the novel wrist/hand support aid shown in FIG. 1.
Figure 3:
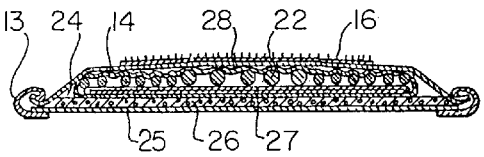
FIG. 3 is a transverse cross-sectional view of the aid shown in FIG. 2 as taken in the direction of arrows 3—3 thereof.

Referring now in detail to FIGS. 2 and 3, it can be seen that the terminating free ends of the straps 15 and 18 respectively include additional hook and pile components 20 and 21 which detachably connect with the components 16 and 17 respectively. Also, it is noted that the wraps for the straps are alternate since the strap 15 will be wrapped about the wrist of the user in a double encirclement from one side of the base 13 while the finger strap 18 wraps from the opposite side of the base 13 about the middle fingers of the user. The brace member 14 includes a plurality of elongated rigid rods, such as rod 22, arranged in an assembly and which includes opposite ends that are tucked into pockets such as a pocket 23 carried at one end of a sheet or sleeve. The construction and variations of the brace member 14 are more clearly described with respect to FIGS. 4–7 inclusive.

Referring now in detail to FIG. 3, it can be seen that the base 13 forms a sleeve having an internal compartment 24 in which the brace member 14 is disposed. The base member includes a lower or under fiber or fabric sheet 25 which includes a cushioned or padded layer 26 for the comfort of the user. The brace member 14 includes an under layer or sheet 27 with an upper layer or sheet 28 which in FIG. 3, represents a pocket for receiving the ends of the rods 22 opposite from the pocket 23 shown in FIG. 2. It is to be particularly noticed that the plurality of elongated rigid rods 22 are separated from one another and that this permits the brace member to be flexed about the longitudinal central axis of the member. In other words, flexure may occur laterally or transversely of the central longitudinal axis since there is no rigid support in a lateral or transverse direction. However, it is also to be noted that the brace member prevents bending of the hand with respect to the wrist which may be referred to as a longitudinal direction with respect to the length of the brace member.

Figure 4:
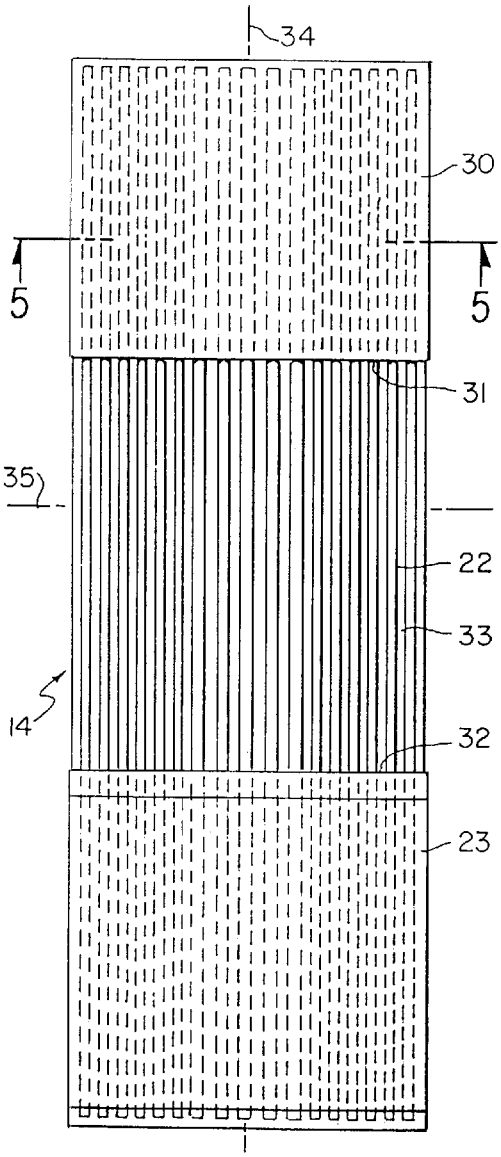
FIG. 4 is an enlarged top view of a brace member incorporated into the aid shown in FIG. 2.
Figure 5:
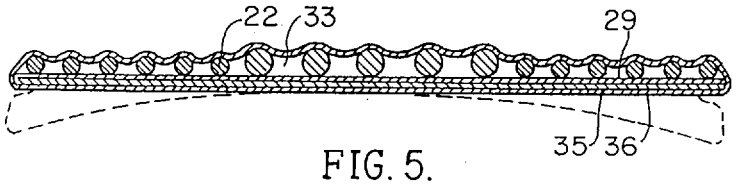
FIG. 5 is a transverse cross-sectional view taken in the direction of arrows 5—5 of FIG. 4.

Referring in detail to FIGS. 4 and 5, the brace member 14 is illustrated wherein a holder for the plurality of rigid rods is defined as having a length of flexible material 29 which is folded over upon itself at each end so as to provide pockets 23 and 30 respectively. The pockets are open-ended as represented by numerals 31 and 32 so that the pockets are arranged in fixed spaced-apart relationship and the rods 22 may be exposed in this central area. It is again particularly to be noticed that the rods are in spaced-apart relationship and are separated by material of the layer 29 and the separation is identified by numeral 33. Therefore, it can be seen that a plurality of separation areas 33 are provided between adjacent ones of the plurality of rods 22 and that these separation areas may be considered similar to a hinge or flexible portions so that the plurality of rods may be flexed about a central longitudinal axis represented by numeral 34, while the brace member cannot be flexed laterally or along a transverse axis, such as represented by numeral 35. The bending or flexing in a lateral or transverse direction is illustrated in broken lines in FIG. 5. Also, if desired, an additional layer of material 36 can be provided between the sheet or layer 29 and an underlying layer 36. In FIG. 4, the plurality of rigid rods are arranged in parallel spaced-apart relationship.

Figure 6:
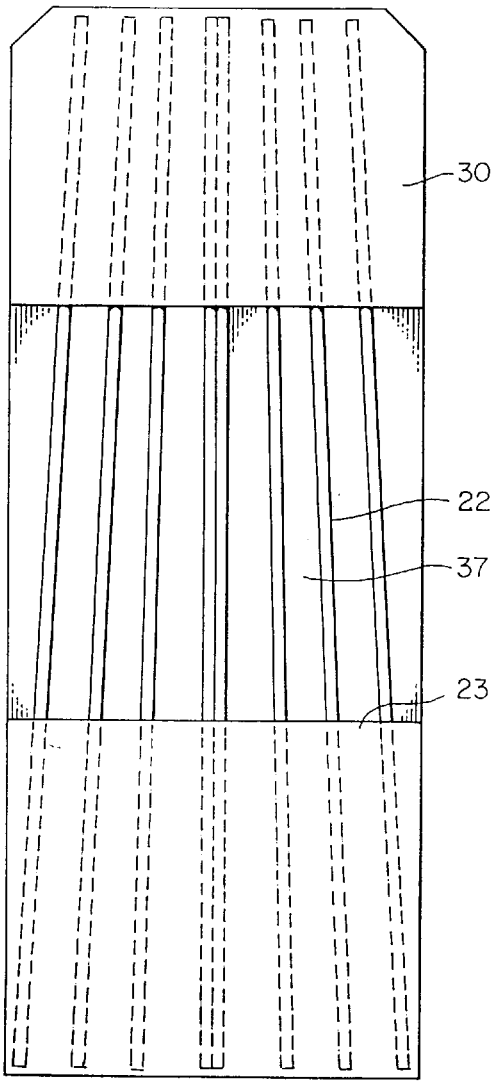
FIG. 6 is an enlarged top plan view of another embodiment for a brace member.

Referring now in detail to FIG. 6, a different version of brace member is illustrated in which the plurality of rods are arranged in an angular or fanned-out position. The ends of the rods, such as rod 22, are arranged close together within pocket 30 while the opposite ends are fanned radially and covered by pocket 23. The rods arranged in this pattern greatly reduce the number of rods needed to give rigidity and the flexing of the brace member in a lateral or transverse direction, as previously described, is permitted since the flex areas between adjacent rods are substantially wider and of greater area. Such a flex area is indicated by numeral 37.

Figure 7:
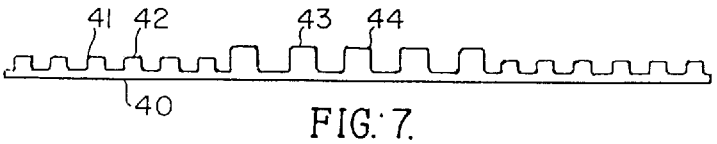
FIG. 7 is an end view of a brace member illustrating another embodiment.

Still another version of brace member is illustrated in FIG. 7 in which the member is composed of a single unitary construction composed of a plastic or plastic-like material which includes a sheet 40 having a plurality of ribs integrally formed therewith. Certain ribs can be of the same height, such as represented by ribs 41 and 42, while central ribs 43 and 44 may be of a greater height. The ribs are longitudinal in a similar manner as the rods 22 and therefore prevent flexing anywhere along the longitudinal length but permitting lateral or transverse flexing about the ribs 43 and 44 which are of greater material density. The embodiment shown in FIG. 7 may be incorporated on the base holder 13 in a suitable manner, such as employing pockets, adhesives or other fastening means.

In view of the foregoing, it can be seen that the hand/wrist brace of the present invention differs from other support concepts in that instead of employing a stamped and/or shaped piece of aluminum or rigid sheet steel, the present invention employs the concept of rib construction taking the form of integral ribs as shown in FIG. 7 or a plurality of spaced-apart rods, as shown in the other figures. The rods or ribs are provided in a series which runs the length of the member so as to give strength but allowing flexure about the central longitudinal axis but not allowing for flexure about a transverse axis. The series of rods may be composed of music wire, carbon fiber and/or fiberglass plastic rods which are secured to the backing material that may be composed of either vinyl, thin flexible plastic sheeting or some other suitable material, and can be held together by means of a double adhesive tape. The rods may vary in diameter anywhere from one-eighth inch to one-sixteenth inch and in length from five inches to ten inches.

Rather than being placed in a side-by-side relationship, the rods may be spaced in varying amounts, such as shown in FIG. 6. The backing material to which the rods are secured is placed in a pocket or pouch at opposite ends of a sleeve or sheeting which is then attached to the wrist/hand base by appropriately placed straps, preferably at each end of the base. Because the rods are spaced-apart, the pouch shapes itself to the user's hand and wrist and it is from this that the unit gains its supporting strength. The sides of the device or brace member are straight for both right and left-handed persons and the device may be worn by either right or left-handed persons. If desired, the straps may be composed of an elastic material so as to provide a yieldable tightening force to hold the device in place on a user's wrist and at the front of the hand where the fingers join therewith. The brace member may be placed immediately under the base followed by retention of the brace member in place when the straps are connected. However, it is to be understood that the base member may include a sleeve or compartment into which the brace member can be slid so that a single construction is provided. An example of this construction is shown in FIG. 3.

Referring now to FIG. 8, a perspective view of the rigid member 14 is illustrated wherein the opposite ends of rods 22 are tucked into pockets 23 and 30 respectively. The rods are arranged in fixed spaced-apart relationship and may be parallel or angular; however, the adjacent rods are separated by flexible material 33 which permits lateral rotation or bending of the rigid member about the longitudinal axis of the rigid member.

Referring now to FIG. 9, another embodiment of the rigid member is illustrated in the direction of arrow 50 which includes an elongated member 51 which includes a plurality of parallel slots or cuts, such as indicated by slots 52 and 53. The slots are open on one side of the member 51 but do not extend clear through the thickness of the member 51. Therefore, the member 51 can be flexed, as shown in broken lines and represented by numeral 54 about the longitudinal axis of the member. The slots or cuts 52, 53 and the others permit the bowing or bending of the member and separate from one another depending on the extent of flexure or bend.

Referring now to FIG. 10, another embodiment of a rigid member is illustrated in the direction of arrow 55 which is similar to the embodiment shown in FIG. 9 with the exception that the parallel cuts, such as cut 56, are wedge-shaped between adjacent cuts so as to provide a wedge shape in transverse cross-section. Again, the cuts are not completely through the thickness of the member which is identified by numeral 57, so that the member can be bent along its longitudinal axis in a lateral direction as illustrated in broken lines. Therefore, it is noted that the cross-section of the plurality of ribs defined by the cuts is of square cross-section in FIG. 9 while the cross-section of the plurality of ribs defined between the cuts 56 are of wedge shape configuration. The flexure of the member 57 is illustrated in broken lines by numeral 58.

Referring now to FIG. 11, another embodiment of a wrist/hand supporting aid is illustrated in the general direction of arrow 60 which includes a base member 61 having one component of Velcro carried on the surface thereof and having the rigid member underneath the member 61 as identified by numeral 62. The rigid member 62 is substantially as described earlier with the provision that one component of a hook and pile fastener is carried on the upper surface thereof and is identified by numeral 63. This component attaches to an alternate component on the underside of the base 61. It can also be seen that the means for holding the base and the rigid member onto the back of the user's wrist and hand takes the form of straps, such as wrist strap 64, mid strap 65 and finger strap or end strap 66. The opposite ends of the straps include a component of a hook and pile fastener so that one end of each strap can be attached to the base 61 while the opposite end is wrapped around the support aid and the wrist and hand of the user for fastening in the usual manner when the components are mated.

In FIG. 12, the installation of the embodiment 60 onto the back of the user's wrist and hand is illustrated with the opposite end of the respective straps joined by the hook and pile fastener. It can be seen that the rigid member 62 is disposed between the underside of the base 61 and the back of the user's wrist and hand. A distinct advantage is gained by using the detachable straps in that the straps can be arranged for convenient and releasable holding of the support aid onto the user's wrist and hand and the device can be used for right and left-handed persons.

Referring now to FIG. 13, an alternate embodiment of the invention is illustrated in the general direction of arrow 70 in which the base member is indicated by numeral 71 and takes the form of a sleeve having an opening at opposite ends to define a compartment 72 which is occupied by the rigid member 73. For purposes of explanation, the rigid member 73 is illustrated substantially similar to the embodiment shown in FIG. 4; however, it is to be understood that the rigid member may take the form of that which is illustrated by numerals 50, 55 or as shown in FIG. 6. The base 71 is carried on a sheet 73 which has opposite straps 74 and 75 with components of a hook and pile fastener on opposite ends. When the sheet and straps are folded about the user's wrist and hand, as indicated in broken lines by numerals 76 and 77, the support aid is removably connected to the user. Tabs 78 and 79 are employed for insertably retaining the rigid member 73 in place.

Also, FIG. 13 illustrates the employment of a wedge system for controlling the rotation of the user's wrist. The purpose of having different degrees of tilt, which are provided by wedge elements, such as wedge element 80, is to increase or decrease rotation of the wrist which can be placed on the ball, depending on which type of wedge a person uses. The wedge system of which wedge element 80 is a typical embodiment, works by having a various set of wedges that consist of different angles which are attached to the support aid by hook and pile fasteners or the like. The user may simply pull off one wedge element of the set and replace it with another. The wedges are not limited to top-to-bottom angles but may also have side-to-side angles. In FIG. 13, the wedge element 80 includes end 81 which is thicker than end 82 and the side elevational view defines a wedge shape. The wedge element is inserted beneath the support aid and when installed on the wrist and hand of the user, the embodiment takes the form as shown in FIG. 14.

In FIG. 14, the strap ends 74 and 75 have been rotated around the wrist and hand of the user and the wedge element 80 is completely covered by the base 71. It is also to be noted that the sheet 73 includes an opening 83 through which the thumb of the user projects.

Referring to FIGS. 15 and 16, cross-sectional and end views of different wedge elements are illustrated wherein in FIG. 15, the end of wedge element 80 is illustrated with its opposite surfaces terminating in a common juncture represented by numeral 84.

With respect to the embodiment of the wedge element shown in FIG. 16, the undersurface, indicated by numeral 85 of the wedge element opposite from the flat planar surface 86, is of an irregular configuration so as to reflect a side-to-side relationship. The rigid tapered wedge element 81 may be referred to as a top-to-bottom angle.

Therefore, it can be seen that the wrist/hand support aid, including the wedge system, is useful in controlling the delivery of a bowling ball down a bowling alley. Hook and pile fasteners are used to maintain the support aid in place as well as any selected wedges and maintains the wrist firm. The straps, such as straps 64 and 65 in FIG. 11, may be elastic to further offer retention of the support aid onto the wrist and hand. The straps go around the wrist and hand and lock in place with the fasteners. The pull of the strap during placement is towards the body to hold the brace in place at the start of a wrapping procedure. If desired, a palm strap, such as strap number 66 in connection with the support aid shown in FIGS. 11 and 12 may be used so that the fingers are completely free. The wedge system provides for the insertion of the selected wedge from a set of different shaped wedges which may be inserted between the brace and the back of the hand at the palm so as to cause or support a curved hand. The insert may be to accommodate lateral or longitudinal adjustment.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A wrist and hand brace for bowlers comprising:

an elongated base having opposite ends;

strap means carried on said base opposite ends adapted to wrap around the wrist and hand of the user;

an elongated rigid brace member disposed between said base and the wrist and hand of the user;

said rigid brace member having a plurality of rigid non-bendable elements arranged in spaced-apart relationship along the length of said brace member;

said brace member characterized as being flexible about a central longitudinal axis of said elongated brace member;

a wedge-shaped element disposed between the hand of the user and said elongated brace; and said wedge-shaped element has opposite sides of unequal thickness.

2. The invention as defined in claim 1 wherein:

said brace includes flexible areas between and separating adjacent ones of said rigid brace member to permit bending of said brace member laterally of said central longitudinal axis whereby said brace member form fits to the back of the user's wrist and hand.

3. The wrist brace as defined in claim 2 wherein:

said rigid elements are elongated rods.

4. The wrist brace as defined in claim 3 wherein:

said elongated rigid rods are in parallel spaced-apart relationship.

5. The wrist brace as defined in claim 4 wherein:

said brace member includes a sheet of flexible material having said elongated rigid rods secured thereon;

said rigid rods having opposite ends; and open-ended pockets on each end of said sheet for receiving and regaining said opposite ends of said plurality of rigid rods.

6. The wrist brace as defined in claim 2 wherein:

said elongated rigid rods are in a radical pattern fanning outwardly from the location of the wrist towards the hand.

7. The wrist brace defined in claim 2 wherein:

said brace member is a unitary construction of a base having a plurality of integral ribs forming said elongated rigid elements; and flexible areas between said ribs permitting lateral bending of said brace member about said central longitudinal axis.

8. The wrist brace as defined in claim 2 wherein:

said strap means includes hook and pile fasteners to effect detachable closure; and one strap of said strap means attached to a selected side of said base and the other strap of said strap means attached to a non-selected side of said base.

9. The wrist brace as defined in claim 8 wherein:

said base and said brace member are adapted to be worn by right or left-handed users.

10. A wrist and hand brace for bowlers comprising:

a flexible base retainer;

an elongated brace member adapted to bear against the back of the user's hand and wrist and selectively flexible in a lateral direction about a central longitudinal axis of said brace member and non-flexible along the length of said central longitudinal axis;

strap means carried on said base retainer to releasably secure said base retainer and said brace member in position; and a set of wedge-shaped elements of different thicknesses for selective disposition between said flexible base retainer and the hand of the user for controlling rotation of the user's hand during delivery of a bowling ball.

11. The wrist and hand brace as defined in claim 10 wherein:

said brace member includes a plurality of elongated rigid rods arranged in spaced-apart relationship and adjacent ones of said rods separated by a flexible portion.

12. The brace as defined in claim 10 wherein:

said set of wedges includes different shaped wedge elements chosen from tapered wedge elements, whereby different degrees of hand tilt increase or decrease wrist rotation.

13. The brace as defined in claim 12 including:

detachable fastening means releasably joining a selected wedge element to said base retainer.

* * * * *